US005103856A

United States Patent [19]

Fleischmann

[11] Patent Number: 5,103,856

[45] Date of Patent: Apr. 14, 1992

[54] ANTI-SIPHONING VALVE ASSEMBLY

[75] Inventor: Gary A. Fleischmann, Sheboygan, Wis.

[73] Assignee: Kohler Co., Kohler, Wis.

[21] Appl. No.: 654,167

[22] Filed: Feb. 11, 1991

[51] Int. Cl.[5] ..... F16K 24/00; E03C 1/10

[52] U.S. Cl. ..... 137/218; 137/217

[58] Field of Search ..... 137/217, 218

[56] References Cited

U.S. PATENT DOCUMENTS

| | | | |
|---|---|---|---|
| Re. 26,235 | 7/1967 | Woodford | 137/218 |
| D. 297,257 | 8/1988 | Kohler, Jr. et al. | D23/252 |
| 926,968 | 7/1909 | Stickdorn | 137/218 |
| 2,259,984 | 10/1941 | Anderson | 277/60 |
| 2,756,763 | 7/1956 | Morgenstern | 137/217 |
| 2,850,034 | 9/1958 | Svabek | 137/218 |
| 3,104,674 | 9/1963 | Bills et al. | 137/218 |
| 3,145,724 | 8/1964 | Pelzer | 137/417 |
| 3,414,003 | 12/1968 | Wyckoff | 137/217 |
| 3,424,189 | 1/1969 | Woodford | 137/218 |
| 3,929,149 | 12/1975 | Phillips | 137/218 X |
| 4,478,236 | 10/1984 | Neuzeret et al. | 137/107 |
| 4,489,746 | 12/1984 | Daghe et al. | 137/218 |
| 4,508,137 | 4/1985 | Bolgert | 137/218 |
| 4,553,563 | 11/1985 | Daghe et al. | 137/494 |
| 4,805,661 | 2/1989 | Knapp et al. | 137/218 |
| 4,821,762 | 4/1989 | Breneman | 137/218 |
| 5,038,814 | 8/1991 | Gayton et al. | 137/218 |

FOREIGN PATENT DOCUMENTS

| | | | |
|---|---|---|---|
| 1143992 | 4/1983 | Canada . | |
| 1144209 | 2/1963 | Fed. Rep. of Germany | 137/218 |

OTHER PUBLICATIONS

Page from a catalog which illustrates a faucet design designated K-15176 and K-15173 (undated).

Page from a catalog showing Harden faucet assemblies (undated).

Page from a catalog showing a faucet assembly with a pull-out spray head (undated).

*Primary Examiner*—Gerald A. Michalsky

*Attorney, Agent, or Firm*—Quarles & Brady

[57] ABSTRACT

A faucet with a pull-out spray head includes a mixing valve for combining water from hot and cold supply lines. Water from the mixing valve flows through a check valve assembly having a chamber with an inlet, connected to the mixing valve, and an outlet, that is connected to the spray head. Separate check valves are located in the inlet and the outlet to restrict water flow through the check valve assembly to only the direction from the inlet to the outlet. A hose connects the intermediate chamber of the check valve mechanism to a vacuum breaker adapted to mount next to the faucet. The vacuum breaker includes a housing with an internal cavity into which the conduit communicates. An aperture in the vacuum breaker housing provides a passage between the cavity and the ambient environment of the faucet. Located within the chamber of the vacuum breaker assembly is a float which seals the aperture when pressure within the intermediate chamber of the check valve assembly is significantly greater than the atmospheric pressure of the ambient environment of the faucet. The aperture is opened when the intermediate chamber pressure is less than the atmospheric pressure.

15 Claims, 2 Drawing Sheets

ANTI-SIPHONING VALVE ASSEMBLY

The present invention relates to devices for preventing the back-flow of water in plumbing systems, and in particular to vacuum breaker type anti-siphoning mechanisms.

BACKGROUND OF THE INVENTION

Presently available pull-out spray faucets provide a conventional valve assembly for mixing water from hot and cold supply lines and sending it through a hose to a hand-held spray head. Such faucets are commonly used in beauty parlors and home bathrooms to enable one to wash hair at a lavatory. In addition, faucets of this type are found at the kitchen sink for cleaning food items and dishes.

Improper use of a pull-out spray faucet may contaminate the potable water supply lines. This condition occurs when the spray head is immersed in non-potable water, such as water filling a sink. If the faucet's mixing valve also is open and a negative pressure occurs in the plumbing system at the faucet, a back-flow or siphoning of water from the sink through the faucet and into the plumbing system may occur. This back-flow introduces unsanitary water into the potable water supply.

In light of this potentially hazardous and unsanitary condition, it is essential that a means be provided to prevent the water back-flow. Many pull-out spray faucets on the market today incorporate a check valve in their inlet lines. Such check valves allow water to flow in only one direction through the valve, from the supply lines out through the faucet hose and spray head. Any negative pressure in the supply lines, which would create a back-flow, causes the check valve to close preventing a siphoning of waste water should the spray head be immersed. Although under ideal conditions, such check valves provide a safeguard against back-flow, mineral deposits, rust and other particles within the water lines can cause the check valve to stick in the open position. In addition, the check valve sealing members eventually wear, age and corrode rendering the valve non-functional. Therefore, it is desirable to provide a secondary mechanism to prevent an unsanitary back flow condition.

SUMMARY OF THE INVENTION

An anti-siphoning fitting for a plumbing system includes a check valve assembly and a vacuum breaker. The check valve assembly has an inlet and an outlet with an intermediate chamber therebetween. The inlet receives water from a supply and the outlet is connected to a water utilization device. Separate check valves are located in the inlet and the outlet to restrict water flow through the check valve assembly to only the direction from the inlet to the outlet. Preferably, non-spring operated check valves, such as "duck-bill" type valves, are used to provide quieter operation.

One end of a conduit communicates with the intermediate chamber of the check valve mechanism. The other end of the conduit couples to a vacuum breaker assembly. The vacuum breaker assembly includes a housing, forming an internal cavity into which the conduit communicates. An opening in the vacuum breaker housing provides a passage between the cavity and the ambient atmosphere. Located within the cavity of the vacuum breaker is a float which includes a sealing means. The float is so positioned that when the pressure within the intermediate chamber of the check valve assembly is significantly greater than the ambient atmospheric pressure, the float will be pressed against the vacuum breaker housing so that its sealing means closes the opening in the housing. However, when the pressure within the intermediate chamber of the check valve assembly is at or less than the ambient atmospheric pressure, the float is moved from its sealing engagement with the vacuum breaker housing permitting air to enter the internal cavity of the vacuum breaker housing and the conduit that extends to the intermediate chamber of the check valve assembly.

The check valve assembly and the vacuum breaker are separate elements connected by the conduit. This allows the vacuum breaker to be mounted on the rim of a sink with the check valve assembly connected to plumbing line beneath the sink. In this particular installation, the vacuum breaker can be disassembled from above the sink for maintenance. In addition, separating the check valve from the vacuum breaker permits the check valve to be mounted in any orientation, whereas the preferred embodiment of the vacuum breaker requires a specific orientation.

A general object of the present invention is to provide an anti-siphoning mechanism which prevents the back-flow of a fluid through a section of the plumbing system.

A specific object is to provide a check valve assembly for the anti-siphoning mechanism which is relatively free of obstructions that could interfere with the fluid flow causing cavitation and pressure reduction.

Another object of the present invention is to provide a vacuum breaker as another device which prevents the back-flow of fluid through the plumbing system should the check valves become stuck open.

A further object is to provide a vacuum breaker that can be mounted on the sink rim or a counter top adjacent the sink in a manner that permits access to the internal components of the vacuum breaker for ease of maintenance. Occasional water leakage from the vacuum breaker would not be deemed objectionable in this mounting location.

Still another object of the present invention is to have separately mountable elements for the check valve and vacuum breaker. This allows the check valve to be mounted in any orientation without affecting the operation of the vacuum breaker.

Yet another object is to provide a vacuum breaker in a separate body through which water does not flow between the supply line and the water output line. Thus, the present anti-syphon device minimizes the pressure drop of water flowing therethrough.

Another object is to provide a vacuum breaker mechanism that operates effectively even under conditions of minimum fluid flow and pressure.

DETAILED DESCRIPTION OF THE INVENTION

Figure 1:
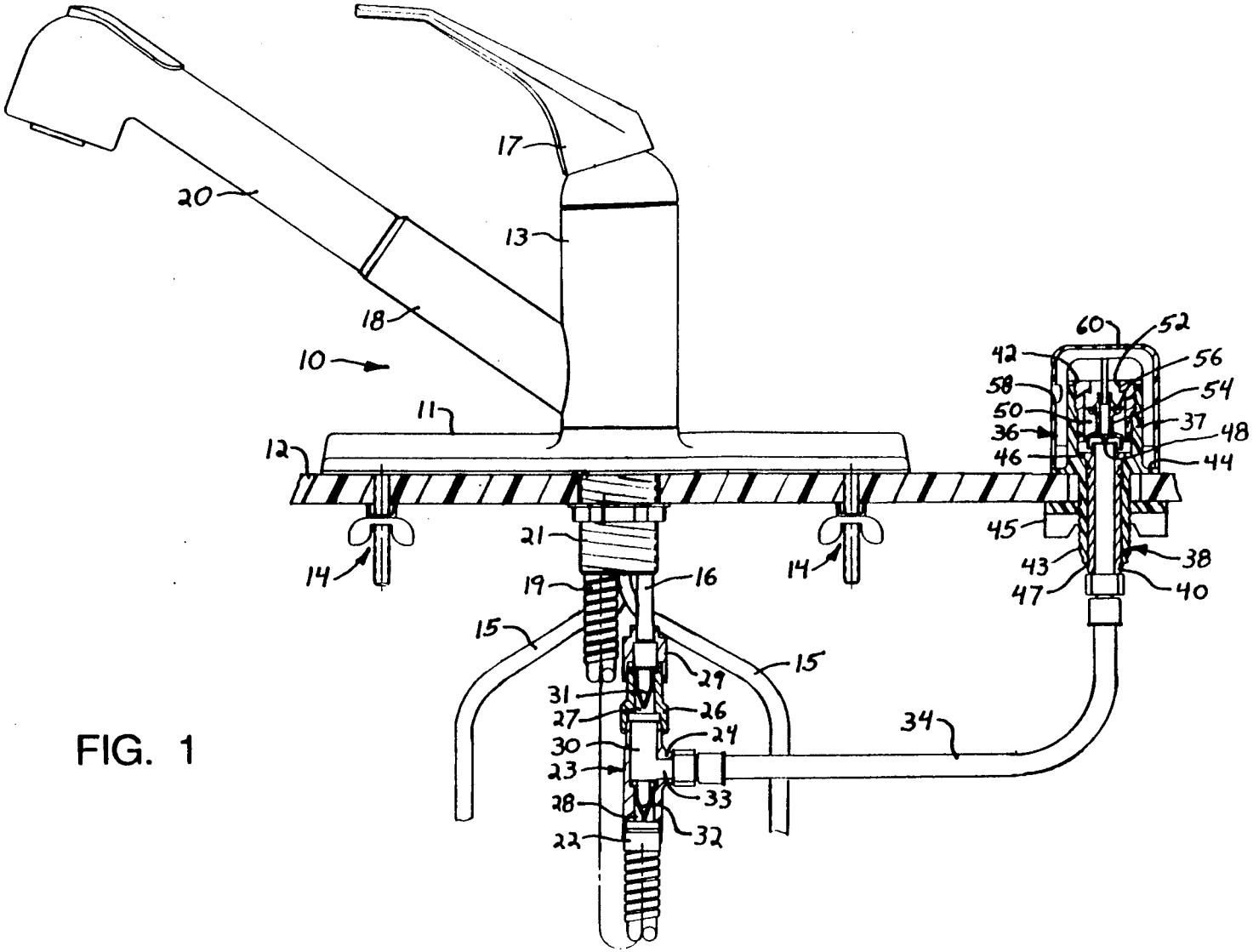
FIG. 1 is a partial sectional view of a faucet which incorporates the present anti-siphoning check valve and vacuum breaker assembly.

With initial reference to FIG. 1, a pull-out spray faucet 10 according to the present invention includes a base 11 which rests on and is attached to a rim of a sink 12 or to a counter top adjacent the sink. A tube 21 extends downward from the base 11 through an aperture in the sink rim or counter top and has a nut screwed thereon to hold the faucet 10 in place. Additional attachment mechanisms 14, such as bolts and nuts, also engage the sink or counter to hold the faucet in place. A hollow pedestal 13 extends upward from the base 11 and is pivotally coupled thereto, The pedestal 13 contains a conventional mixing valve for combining water from hot and cold water supply lines 15 and supplying the mixture to an outlet tube 16. The mixing valve is controlled by a single lever 17 mounted on the top of the pedestal 13. A tubular projection 18 extends at an upward angle from the pedestal 13. Although a single lever mixing valve faucet is illustrated, the present invention is equally applicable to faucets with separate valves for each supply line and even single supply line faucets.

A first flexible hose 19 extends upward from the underside of the sink 12 through through the fastening tube 21, pedestal 13 and tubular projection 18. One end of the first hose 19 is attached to a conventional spray head 20, which forms a spout of the faucet. FIG. 1 illustrates the spray head 20 placed within the opening of the tubular projection 18 which conceals the attachment to first hose 19. The spray head 20 can remain in engagement with the projection during use, and is positioned by pivoting the pedestal as one would position a conventional faucet spout. Alternatively, the user of the faucet may grasp the spray head 20 removing it from engagement with the tubular projection 18 and pulling the first hose 19 through the tubular projection 18 and pedestal 13.

A check valve assembly 23 connects the other end 22 of the first hose 19 to the outlet tube 16 from the mixing valve. This assembly 23 includes a Tee fitting 24, a coupling 26 and a compression fitting 29 connected to the outlet tube 16 and providing an inlet passage 27 in the check valve assembly. The Tee fitting 24 has an outlet passage 28 into which the first hose 19 is threaded. An intermediate chamber 30 is formed within the check valve assembly 23 between inlet 27 and outlet 28 passages. The Tee fitting 24 has an ancillary passage 33 which communicates with the intermediate chamber 30.

A first duck-bill check valve 31 is located at the inlet passage 27 between the compression fitting 29 and the coupling 26. A second duck-bill check valve 32 is located within the outlet passage 28. Each duck-bill check valve 31 and 32 is a tubular piece of rubber that tapers to a linear edge, thereby resembling the bill of a duck. A slit is formed in the linear edge. Water can flow out of the duck-bill check valve (downward in the drawings) by deforming the slit to provide an opening. However, fluid flowing in the opposite direction (upward in the drawings) forces the slit closed so that fluid can not enter the duck-bill check valve from that direction. The two duck-bill check valves 31 and 32 restrict the flow of water to a direction from the mixing valve outlet tube 16 to the spray head 20. Although duck-bill type check valves are preferred, other types of check valves can be used in the present design. While the check valve assembly 23 is illustrated in a position in which the water flows through it in the vertical direction, the assembly can be mounted for horizontal flow or in any other orientation without affecting the operation of the check valves.

A second flexible hose 34 couples the ancillary passage 33 to a vacuum breaker 36, providing a conduit therebetween. The vacuum breaker 36, shown enlarged in FIG. 2, has a body formed by a cylindrical tubular member 38, coupling tube 40 and plug 42. Member 38 has a cup-like portion 37 from which a tubular projection 43 extends through another aperture in the rim of sink 12. A flange 44 extends outwardly from the bottom of the cup-like portion 37 abutting an upper surface of the sink rim around the other aperture. A nut 45 is threaded onto the projection 43 until it abuts the underside of the sink 12 to firmly hold the vacuum breaker 36 in place. This mounting also places the vacuum breaker at the same height as the faucet pedestal 13. Alternatively, the vacuum breaker 36 can be similarly mounted through a hole in a counter top adjacent the sink.

The metal coupling tube 40 extends through the central aperture in the tubular projection 43 and has a non-circular flange 46 near one end which fits within a similarly shaped depression in the bottom of the cup-like portion 37 of the tubular member 38. The non-circular flange 46 and mating depression prevent rotation of the coupling tube 40 within the tubular projection 43. The one end of the coupling tube 40 has an upper extension 48 which projects beyond the flange 46 into a cavity 50 within the cup-like portion 37. A pair of O-rings lie within separate grooves around the outer surface of the coupling tube 40 and provide a fluid-tight seal between the tube and the tubular member 38. A ring clip 47 in a groove at the other end of the coupling tube 40 holds the tube within the projection 43. The second hose 34 connects to an exposed threaded section at the other end of coupling tube 40.

The plug 42 engages threads in the inner surface of the cup-like portion 37 which forms cavity 50, thereby closing the mouth of that cavity. An aperture 52 through plug 42 provides a passageway between the cavity 50 and the ambient environment of the vacuum breaker 36. A float 54 is located within the vacuum breaker cavity 50 and is free to move up and down within the cavity 50. The movement of the float 54 is guided vertically by a pin 51 projecting from the plug 42 into a blind hole in the float. A sealing element 56 is attached to the upper section of the float to engage an edge around the plug aperture 52. The bottom surface of the float 54 has an outer annular rim 57 A rib 55, formed on the bottom surface within the rim 57, rests against the end of the upper extension 48 of the coupling tube 40 in the state of the vacuum breaker illustrated in FIG. 1. The rib 55 prevents the float from sealing that end of the coupling tube 40.

A protective cap 60 extends over the body of the vacuum breaker and frictionally engages the flange 44. The cap 60 can be pulled off the flange 44 for access to the inner components of the vacuum breaker 36, in which case the plug 42 can be unscrewed to service the float 54. A elongated aperture 58 in the cap 60 provides an air passage.

FIG. 1 illustrates the faucet 10 in the closed state in which water does not flow from the supply line 15 out the spray head 20. In this state, both of the duck-bill check valves 31 and 32 are in the closed position in which the sides of the end slit are together. Furthermore, since water pressure from the supply lines 15 is not applied to the inner chamber 30 of the check valve 23, the chamber is at the same pressure as the atmospheric pressure of the faucet ambient environment. This pressure level is transmitted from the chamber 30 through the second hose 34 to the cavity 50 of the vacuum breaker 36. When the pressure within the vacuum breaker cavity 50 is equal to or less than the pressure of its ambient atmosphere, the float 54 drops due to gravity until it strikes the upper extension 48 of the coupling tube 40. Such operation due to gravity typically is quieter than spring operated vacuum breakers. With the float 54 dropped downward, the aperture 52 in plug 42 is opened allowing air to enter the inner cavity 50 pass around the float 54 and into the coupling tube 40 and second hose 34.

Figure 2:
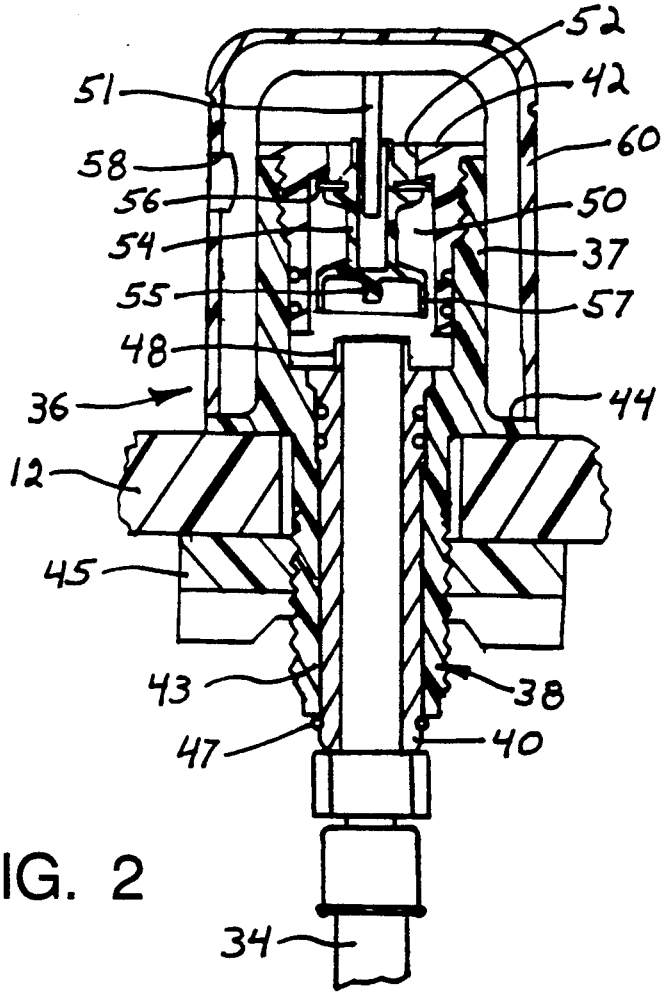
FIG. 2 is a cross-section of the vacuum breaker of FIG. 1 in a state which occurs when water is flowing properly through the faucet.

The closure of the first duck-bill check valve 31 prevents water which remains in the first hose 19 and spray head 30 from flowing into the check valve assembly 23, second hose 34, and out the vacuum breaker 36. Any flow in this backward direction tends to force the slit of the first duck-bill check valve 31 closed. However, even if the first duck-bill check valve 31 is blocked open, the water remaining in the spray head 20 and first hose 19 would raise the float 54 of the vacuum breaker 36 into a position which seals aperture 52, as shown in FIG. 2.

When the mixing valve in faucet 10 is opened under normal operating conditions, the pressure of the water within the supply lines 15 is greater than the ambient atmospheric pressure of the vacuum breaker 36. This results in water flowing from one or both of the supply lines to the outlet tube 16. The water flow opens the duck-bill check valves 31 and 32 and continues through the first hose 19 and spray head 20. The water flowing through the duck-bill check valves 31 and 32 tends to remove any deposits on their sealing surfaces which could interfere with the proper closing of the valves. The path of water through the duck-bill check valve assembly 23 is relatively free of obstructions which could cause cavitation and pressure loss.

At the same time, water is forced into the second hose 34, which blows air from that hose through the vacuum breaker 36. This air exiting the coupling tube 40 pushes the float 54 upward against the plug 42 as illustrated in FIG. 2. The rim 57 around the bottom of the float aids the fluid from the coupling tube in moving the float upward. When this occurs, the sealing element 56 abuts the edge around the plug aperture 52, closing that aperture preventing further escape of air from the second hose 34. This latter action stops further flow of water through the second hose 34 and the vacuum breaker 36. The float 54 operates to close the plug aperture 52 even under low flow and low pressure conditions, since the force of a bias spring does not have to be overcome before the vacuum breaker closes. Nevertheless, by mounting the vacuum breaker 36 above the sink rim, rather than beneath the sink 12 with the check valve assembly 23, any water which does leak through the unit will drain away easily without objection by the user.

Assuming that the user has left the faucet in the open position with the spray head 20 immersed in water, the check valve 23 and the vacuum breaker 36 prevent the water from being siphoned through the spray head 20 and other components of the faucet into the supply lines 15. In this situation, should the pressure in one or both of the supply lines 15 drop below the ambient atmospheric pressure, the duck-bill check valves 31 and 32 will close due to the back-flow of water through them. This mechanism provides an initial safeguard against water being siphoned backwards from the spray head 20 through the faucet 10 and into the supply lines 15.

The vacuum breaker 36 provides a further safeguard against a back-flow occurring, even in the event that both of the duck-bill check valves 31 and 32 become stuck open. During a back-flow condition, the relatively low pressure in the check valve intermediate chamber 30 is communicated through the second hose 34 and reduces the pressure within the vacuum breaker cavity 50 to below atmospheric pressure. This negative pressure causes the float 54 of the vacuum breaker 36 to drop down into the position illustrated in FIG. 1 allowing ambient air to travel through the second hose 34 into the check valve assembly intermediate chamber 30. The cross sectional area of the passage through which this air enters the intermediate chamber 30 is larger than the cross sectional area of the passage through the outlet tube 16. Therefore, the negative pressure from the supply lines 15 draws only air into the outlet tube rather than unsanitary water from the first hose 22.

By positioning the vacuum breaker on the spray head side of the faucet valve, the vacuum breaker is not under pressure when the valve is closed. This location allows the component of the vacuum breaker to be serviced without having to shut off the water other than at the faucet mixing valve. Servicing is facilitated further by mounting the vacuum breaker on the rim of the sink 12. The need for servicing is reduced since water does not flow through the vacuum breaker and mineral deposits will not build up on it components.

Providing separate assemblies for the vacuum breaker 36 and the check valve 23 allows the check valve to be mounted in any orientation without affecting the orientation of the vacuum breaker. As the vacuum breaker must be mounted in generally the orientation shown for proper movement of the float 54, combining the two devices into a single assembly would limit the mounting positions.

I claim:

1. An anti-siphoning apparatus for a plumbing system comprising:

a housing having an chamber, an inlet passage through which a fluid may enter the chamber from a supply, an outlet passage through which a fluid may exit the chamber and the housing, and an ancillary passage in fluid communication with the chamber;

a first means for restricting fluid flow through the inlet passage to only a direction into the chamber;

a second means for restricting fluid flow through the outlet passage to only a direction from the chamber;

a vacuum breaker having a separate body from said housing, a passageway through the body with first and second openings, and a valve means, biased only by gravity, for closing the passageway when pressure at the first opening is greater than pressure at the second opening and for opening the passageway when pressure at the first opening is less than pressure at the second opening, said vacuum breaker having a means for mounting the body through an aperture in a member that is distinct from said housing; and a conduit extending between the ancillary passage of said housing and the first opening of said vacuum breaker.

2. The anti-siphoning apparatus cited in claim 1 wherein the valve means of said vacuum breaker comprises a float within the passageway and which closes the passageway by blocking the second opening.

3. The anti-siphoning apparatus recited in claim 1 wherein the body of said vacuum breaker comprises:

a cup-like portion;

a tubular portion extending from said cup-like portion and being adapted to extend through the aperture in the member and engage the means for mounting; and an end member extending across a mouth of said cup-like portion and having an aperture therethrough which defines the second opening.

4. The anti-siphoning apparatus recited in claim 3 wherein the valve means of said vacuum breaker comprises a moveable float within said cup-like portion for sealing the aperture in said end member to close the passageway.

5. The anti-siphoning apparatus recited in claim 3 wherein the body of said vacuum breaker further comprises tube extending through said tubular portion with one end of said tube extending into said cup-like portion and another end having a means for connecting to said conduit.

6. The anti-siphoning apparatus recited in claim 3 wherein said vacuum breaker further comprises a cover extending over said cup-like portion.

7. The anti-siphoning apparatus recited in claim 1 wherein the body of said vacuum breaker comprises:

a cup-like section having a bottom, a mouth remote from the bottom, and an outwardly extending flange;

a tubular section extending from and opening into the bottom of said cup-like section, said tubular portion being adapted to extend through the aperture in the member and having external threads which engage the means for mounting;

means for connecting said conduit to said tubular portion;

an end member extending across the mouth of said cup-like portion and having an aperture therethrough which defines the second opening; and a cover substantially enclosing said cup-like portion and including an air vent forming means.

8. A plumbing fitting comprising:

a faucet having a user operable valve for controlling fluid flow from a supply line to an outlet tube, and having a spout through which fluid can flow to produce an output stream;

a body forming a chamber and having an inlet passage coupling the outlet tube to the chamber, an outlet passage coupling the spout to the chamber, and an ancillary passage in communication with the chamber;

a first means for restricting fluid flow through the inlet passage to only a direction from the outlet tube into the chamber;

a second means for restricting fluid flow through the outlet passage to only a direction from the chamber to said spout;

a vacuum breaker having a passageway with first and second openings and a valve means for closing the passageway when pressure at the first opening is substantially greater than pressure at the second opening, and for opening the passageway when pressure at the first opening is less than pressure at the second opening; and a conduit connecting the ancillary passage to the first opening of said vacuum breaker.

9. The plumbing fitting as recited in claim 8 further comprising:

first means for mounting said faucet through an aperture in a sink rim; and second means for mounting said vacuum breaker through another aperture in the sink rim.

10. The plumbing fitting as recited in claim 8 wherein further comprising a means for mounting the vacuum breaker through an aperture in a surface and in a position in which said second opening is at an upper part of the passageway.

11. The plumbing fitting recited in claim 8 wherein said first and second means for restricting fluid flow each comprise a duck-bill check valve.

12. The plumbing fitting recited in claim 8 wherein said body has T-shape with three legs, the inlet passage being formed through a first leg, the outlet passage being formed through a second leg, and the ancillary passage being formed through a third leg that is connected to said conduit.

13. The plumbing fitting as recited in claim 8 wherein said conduit is a flexible tube.

14. The anti-siphoning apparatus recited in claim 8 wherein the body of said vacuum breaker comprises:

a cup-like portion partially forming the cavity and having an bottom, a mouth remote from the bottom, and outwardly extending flange;

a tubular portion extending from and opening into the bottom of said cup-like portion, said tubular portion being adapted to extend through an aperture in the member;

means for engaging said tubular portion to hold said tubular portion in the aperture in the member;

means for connecting said conduit to said tubular portion;

an end member extending across the mouth of said cup-like portion and having an aperture therethrough which defines the second opening; and a cover substantially enclosing said cup-like portion and including an air vent forming means.

15. A plumbing fitting comprising:

a faucet having a base for mounting onto a surface, and a user operable valve assembly for mixing fluids from two supply tubes and producing a fluid flow in an outlet tube;

a spray head;

a hose connected to said spray head;

a body forming a chamber and having an inlet passage coupling the outlet tube to the chamber, an outlet passage coupling said hose to the chamber, and an ancillary passage in communication with the chamber;

a first means for restricting fluid flow through the inlet passage to only a direction from the outlet tube into the chamber;

a second means for restricting fluid flow through the outlet passage to only a direction from the chamber to said hose;

a vacuum breaker including a housing having a cavity and means for mounting the housing onto the surface adjacent the faucet; said vacuum breaker also including a first and second openings through the housing to the cavity, and a valve means within said cavity for closing the first opening when pressure within the cavity is substantially greater than atmospheric pressure external to said vacuum breaker, and for opening the first opening when pressure within the cavity is less than the atmospheric pressure; and a flexible conduit connecting the ancillary passage to the first opening of said vacuum breaker.

* * * * *